United States Patent [19]

Bernat

[11] Patent Number: 4,832,343

[45] Date of Patent: May 23, 1989

[54] PUZZLE WITH PIECES HAVING CONTRASTING SURFACES IN RELATIVELY MOVABLE TRACK SEGMENTS

[76] Inventor: James Bernat, 6250 SW. 20 Ter., Miami, Fla. 33155

[21] Appl. No.: 49,654

[22] Filed: May 4, 1987

[51] Int. Cl.[4] ..... A63F 9/08

[52] U.S. Cl. ..... 273/153 S

[58] Field of Search ..... 273/153 S

[56] References Cited

U.S. PATENT DOCUMENTS 4,418,914 12/1983 Bauer ..... 273/153 S
4,452,454 6/1984 Greene ..... 273/153 S
4,553,754 11/1985 Wiggs et al. ..... 273/153 S

FOREIGN PATENT DOCUMENTS 1169682 7/1985 U.S.S.R. ..... 273/153 S

*Primary Examiner*—Anton O. Oechsle

[57] ABSTRACT

A game assembly in the form of a puzzle comprising a plurality of pieces disconnected from one another but successively positioned and collectively movable along the length of a track structure. Opposite exposed surfaces of the pieces are contrastingly designated such as by different colors or the like and wherein the pieces may be selectively positionable into a predetermined array, for purposes of solving the puzzle, by temporarily disconnecting segments of the track structure along with the pieces thereon and repositioning the track segments into a different operable position from an original operable position.

18 Claims, 3 Drawing Sheets

PUZZLE WITH PIECES HAVING CONTRASTING SURFACES IN RELATIVELY MOVABLE TRACK SEGMENTS

BACKGROUND OF THE INVENTION

1. Field of the Invention

This invention relates to a game assembly and more particularly a puzzle type structure which is hand manipulated to the extent of selectively positioning one or a group of a plurality of pieces into a predetermined or cooperative relation to one another as each of the pieces are movable along the length of a track structure. The puzzle may be solved by arranging all of the pieces of a particular grouping in cooperative relation to one another after such pieces have been intermixed with other such pieces of contrasting designations.

2. Description of the Prior Art

Games especially in the forms of puzzles of the type incorporating a number of pieces to be arranged into a predetermined array have been popular for many years and have enjoyed increasing popularity in recent times. The aforementioned increased popularity is due in large part to hand manipulatable puzzles wherein the entire puzzle assembly structure or base must be manipulated, as well as any of the pieces comprising the puzzle, to accomplish arranging the aforementioned pieces in the aforementioned arrays. The "Rubiks Cube" is an example of a puzzle structure of the type set forth above that has increased the interest of the public and the consumer demand for puzzle structures of this type.

One reason for the popularity of this type of puzzle structure is the fact that the puzzle does not have a single solution but rather what appears to be an infinite number of solutions in the attempt to solve the puzzle by arranging a plurality of groups of pieces into cooperative arrays determined by contrasting surface designations such as matching colors, etc. Further, each of the pieces are manipulatable by the hand of the user in effect by manipulating a plurality of other interconnected pieces.

Due to the aforementioned increased popularity there is a demand in the toy industry for puzzles of the type set forth above wherein a plurality of pieces are each moved and selectively positionable into and out of a predetermined array and further wherein the movement of any one piece directly affects or forces the movement of one or more other pieces thereby increasing the difficulty of problem solving.

SUMMARY OF THE INVENTION

The present invention is directed towards a toy structure in the form of a puzzle assembly. The puzzle assembly of the present invention is of the type which incorporates a plurality of pieces identical in configuration and dimension but differing in being contrastingly designated on opposite exposed surfaces thereof. More specifically, the designations may be as simple as painting the exposed surfaces of the various pieces different colors. Dependent upon the intent in solving and playing the subject puzzle assembly, a plurality of piece groupings may be defined by each piece of the grouping having at least one exposed surface of the same color. Solving the puzzle, as to be explained in greater detail hereinafter, may be accomplished by arranging each of the pieces of a respective grouping in a side-by-side or successive or cooperative relation to one another by manipulation of the puzzle frame, etc.

The puzzle assembly of the present invention includes an elongated track structure of a closed configuration. This track structure, being closed, thereby defines a continuous path of travel along its length. One preferred embodiment of the present invention also to be discussed in greater detail hereinafter is the arrangement of the elongated continuous track structure into a figure-8 orientation. The figure-8 is defined by a center assembly interconnecting two end loops wherein each piece passes through the center assembly by means of designated track portions thereof as it passes from one end loop to the next end loop.

An important feature of the present invention is the formation of the aforementioned track structure by a plurality of track segments. The track segments are movable relative to others of the track segment and to the center assembly between preferably two operative positions. Since the puzzle assembly, including a supporting frame structure and track structure, may be viewable and operable from two opposing faces, each of the plurality of pieces may be differently designated on two oppositely exposed surfaces. Each surface of each piece is operatively exposed from one of the two faces of the puzzle assembly proper.

Also in a preferred embodiment, the number of pieces are such as to extend substantially continuously in side-by-side and immediately adjacent relation to one another along almost the entire length of the track assembly. Accordingly, movement of any one of the pieces along the length of the track structure may force movement of all of the pieces along the track structure. By virtue of the fact that each of the track segments may be movable between at least two operative positions, the pieces then mounted on a given track segment travel with that track segment thereby allowing the exposed contrastingly designated surfaces thereof to be changed between opposite faces of the puzzle assembly proper. Changing the various track segments between their operable positions is primarily accomplished due to the existence of a frame assembly interconnecting the various track segments and maintaining each of the track segment into one of their possible operative positions.

The frame assembly comprises a main support element including an elongated shaft extending between opposite ends of the track structure and generally extending along the length thereof in connection with the center assembly interconnecting the two end loops as set forth above. The frame structure further includes a plurality of brace elements each movably secured to the support shaft and extending outwardly therefrom so as to be connected to one of the track segments defining the track structure. In a preferred embodiment to be described in greater detail hereinafter, the brace members are movable relative to the main support shaft but generally secured at an opposite end thereof to respective ones of the track segments. Further, biasing means are provided on the frame structure so as to normally bias each of the track segments into one of the aforementioned operative positions. The structural configuration and components of the track structure are such as to allow positioning of the brace members and their attached track segments against the biasing force of the biasing means so as to selectively change the operable position of any one of the track segments relative to the others. As set forth above, the plurality of pieces then traveling on a given track segment will move with that track segment. It is therefore possible to expose opposite designated surfaces to opposite faces of the puzzle assembly in order to arrange or rearrange the pieces in the aforementioned predetermined arrays or cooperative position relative to the other pieces and thereby solve the puzzle.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
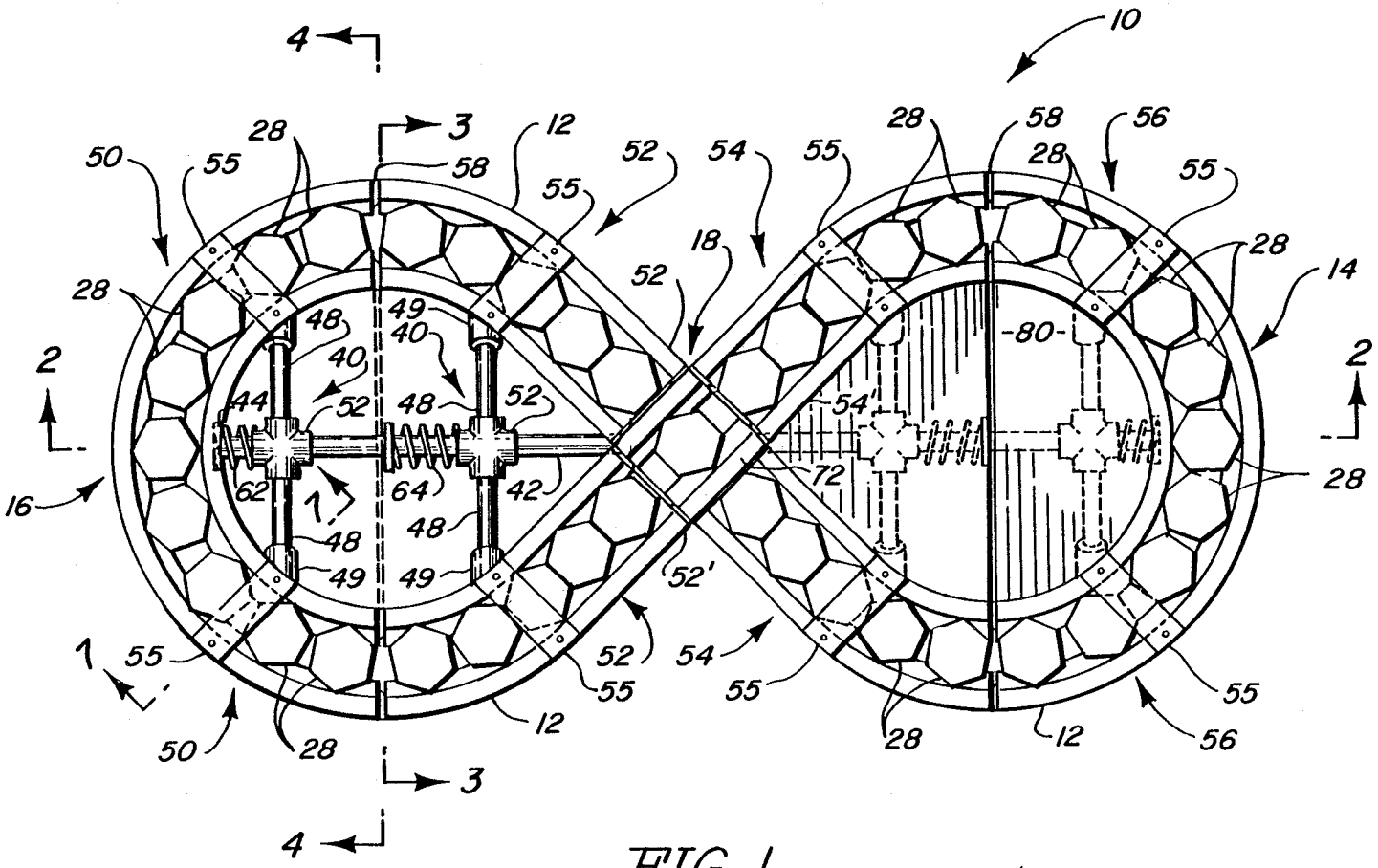
FIG. 1 is a top plan view of the puzzle structure of the present invention.

As shown in FIGS. 1 through 9, the present invention relates to a toy assembly in the form of a puzzle structure generally indicated as 10 including an elongated track structure 12 of a continuous, closed configuration to define a continuous path of travel along the length thereof. As clearly shown in FIG. 1, the track structure 12 is preferably in the form of a figure 8 construction defined by two end loops 14 and 16 removably secured together by a center assembly generally indicated as 18. With references to FIGS. 1 through 4, the track structure 12 comprises, along its length, two inwardly extending flanges 22 and 24 spaced apart in substantially coplanar relation to one another so as to define an elongated space therebetween. The space 26 extends along the entire length of the track structure 12 in a continuous uninterrupted fashion except for the center assembly 18 serving as an interconnection for the end loops 14 and 16. Similarly, the flanges 22 and 24 extend continuously along the length of the track 12 so as to define the longitudinal boundaries of the space 26.

Another important feature of the present invention is the provision of a plurality of pieces 28 movable along the length of the track structure 12 by being slidably retained within the elongated groove 26. As shown in FIG. 1, a preferred embodiment of the subject puzzle structure 10 includes a sufficient number of pieces 28 to essentially be disposed in spaced apart, independent, and successive relation to one another along the length of the track structure 12. Accordingly, movement of any one of the pieces 28 along the length of the track structure 12 will in effect cause movement of the entire plurality of pieces 28. Also, it is noted that each of the pieces are equally dimensioned and congruently configured. While the configuration of each of the pieces may in fact vary from the multi sides pieces shown, a preferred embodiment thereof would again call for all the pieces being equivalently configured and dimensioned. Further, each of the pieces 28 include a mid-portion 30 and oppositely disposed exposed surfaces 32 and 34. The mid-portion 30 is of a sufficiently reduced transverse dimension to fit between the flanges 22 and 24 of the track structure 12 and into the elongated groove 26 for retaining travel therein as set forth above (see FIGS. 2, 3 and 4).

The plurality of pieces 28 are divided into a plurality of groups wherein an equal number of pieces exist within each group. The pieces of each group may be determined by contrastingly designating the exposed surfaces 32 and 34 in such a manner that all the pieces of a specific group are of the same color on at least one of the exposed surfaces and wherein pieces of different groups are contrastingly designated by having a different color thereon. Performance of the puzzle and its solution is therefore accomplished by first arbitrarily arranging all the pieces relative to one another in an uncoordinated manner. The eventual solving of the puzzle occurs by then rearranging all of the pieces 28 so that all of the pieces of the same group are consecutively positioned relative to one another with no intervening pieces of a contrasting color disposed therebetween.

Another feature of the present invention is the existence of a frame structure generally indicated as 40 comprising a main or primary support member in the form of elongated shaft 42 extending along the length of the puzzle structure 10 between opposite ends thereof. As clearly shown in FIGS. 1 and 2, the shaft 42 has its opposite ends removably seated as at 44 within a recess formed in the inner surface of the track structure 12. Further, the approximate mid portion of the shaft 42 is connected to or extends through a mid portion 46 of the center assembly 18. The frame structure 40 further includes a plurality of brace elements 48 having one end secured as at 49 to each of a plurality of track segments 50, 52, 54, and 56. Their innermost end is secured by a slidable connector 52 to the elongated shaft 42 such that the brace elements 48 may be movable along at least a short distance of the shaft 42 as will be explained in greater detail hereinafter. In order to provide additional structural integrity to the track structure 12 and maintain the flanges 22 and 24 in fixed spaced apart relation to one another so as to form the elongated groove or channel 26, connectors 55 are attached to the track structure at spaced apart locations relative to one another. Further it is readily apparent that these connectors 55 are fixedly secured or attached to the brace elements 48.

Figure 2:
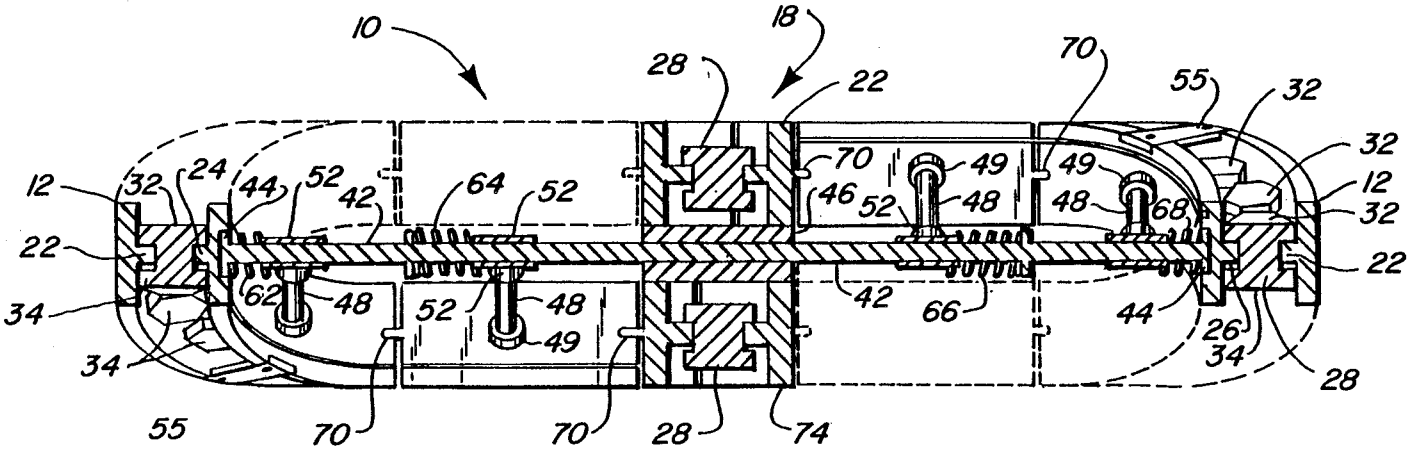
FIG. 2 is a longitudinal sectional view along line 2—2 of FIG. 1 in partial phantom lines.
Figure 4:
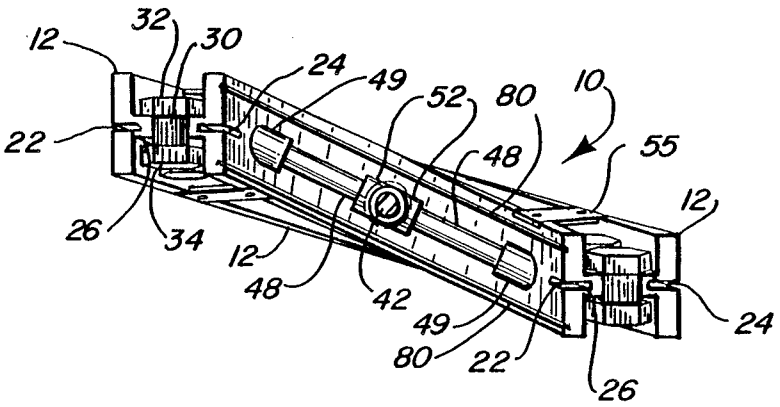
FIG. 4 is a transverse sectional view along line 4—4 of FIG. 1.
Figure 3:
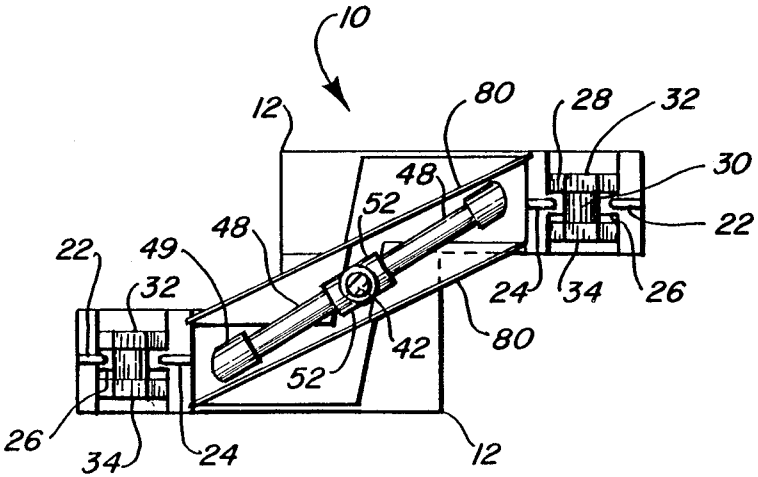
FIG. 3 is a transverse sectional view along line 3—3 of FIG. 1.
Figure 5:
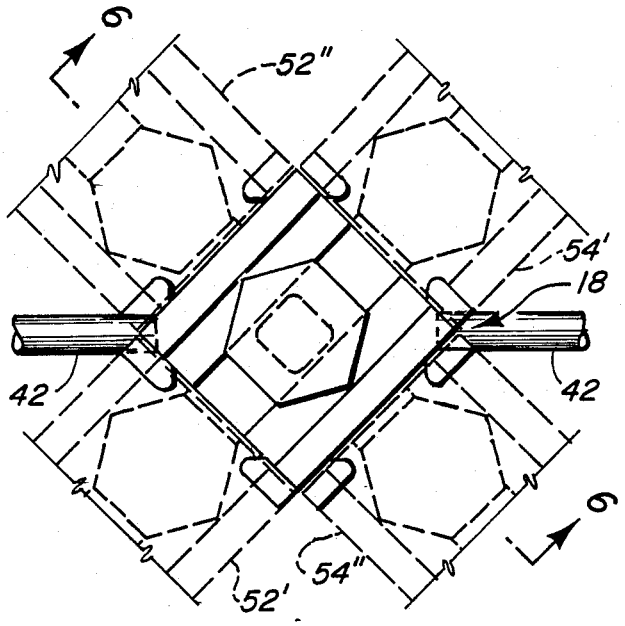
FIG. 5 is a top plan view in partial phantom and cutaway of a central assembly associated with the embodiment of FIG. 1.
Figure 7:
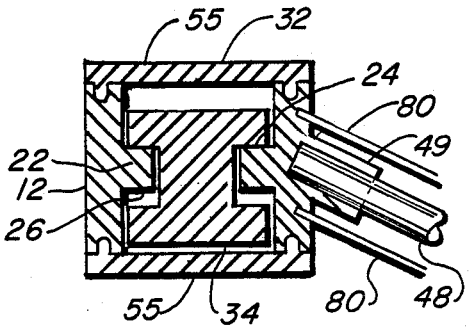
FIG. 7 is a sectional view in partial cutaway along line 7—7 of FIG. 1.
Figure 8:
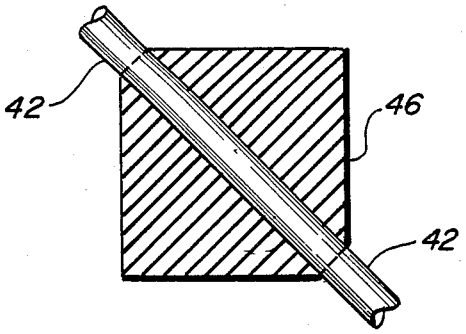
FIG. 8 is a sectional view in partial cutaway along line 8—8 of FIG. 6.
Figure 6:
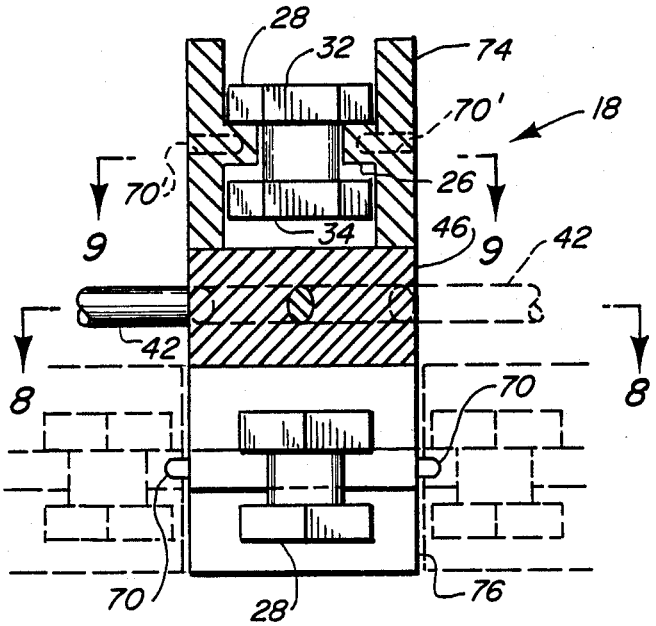
FIG. 6 is a transverse sectional view along line 6—6 of FIG. 5.
Figure 9:
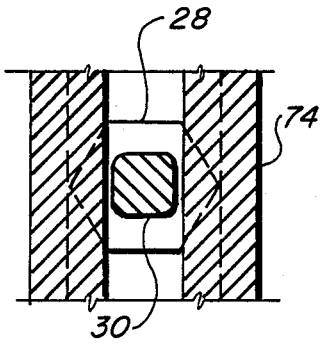
FIG. 9 is a sectional view in partial cutaway along line 9—9 of FIG. 6.

With regard to FIG. 1, it should be noted that the various track segments 50, 52, 54, and 56 are separated from one another by junctions 58. Such junctions allow for the separation of the track segment 50 relative track segment 52 and track segment 54 relative to track segment 56. Further, as set forth above, the track segments 52 and 54 are each separable from the center assembly 18. Biasing means in the form of a plurality of strategically placed biasing springs 60, 62, 64 and 66 are mounted on the shaft 42 and positioned to normally bias the brace elements, through biasing engagement with the connectors 52, into an operative position as pictured in FIG. 1. With reference to FIG. 2, it should be apparent that the positioning of the spring elements 62, 64, 66 and 68 bias the brace elements 48 towards one another and more specifically collectively towards the center assembly 18. However, removable interconnections are provided so as to allow separations of the various adjacently positioned track segments relative to one another and specifically wherein track segments 52 and 54 are separable relative to the center assembly 18. These removable interconnections are accomplished by a plurality of outwardly extending fingers 70 cooperating with correspondingly positioned and mating apertures 70' in which such fingers may be removably received.

It should be apparent that any one of the track segments 50, 52, 54, and 56 may be removed from its next adjacent track segment to which it is removably attached and effectively rotated 180 degrees about the longitudinal axis of the support shaft 42 by a manipulation and rotation of the respective brace element serving to interconnect the respective track segment to the support shaft 42. This is accomplished due to the fact that the connectors 52 are both movable in a sliding fashion along the length of the support shaft 42 and rotatable thereabout. Disconnection of the various track segments from one another is readily accomplished by moving the brace elements 48 and the attached connector elements 52 against the biasing force of the correspondingly positioned biasing springs 62, 64, 66, and 68 until disconnection between adjacent track segments occurs.

With reference to FIGS. 1, 2 and 5 through 9, the center assembly 18 (see FIG. 6) comprises a first track portion 74 and a second track portion 76 fixedly secured to one another and separated by mid portion 46. Further, each of the first and second track portions 74 and 76 are open to allow various pieces 28 to pass therethrough in directions which are transverse to one another as the pieces pass between track segments 52 and 54. Therefore, it should be readily apparent that a first end of each of the track segments 52 and 54 as at 52' and 54' communicate with opposite sides of the first track portion 72 and a second end 52'' and 54'' communicate with and allow pieces to pass through the second track portion 76 of the center assembly 18.

It should be obvious therefore that the various exposed faces 32 and 34 on each piece carried by any given track segment 50, 52, 54 and/or 56 may be reversed by rotating that particular track segment about the longitudinal axis of the support shaft 42 through 180 degrees. The various pieces can therefore be manipulated such that the exposed faces 32 and 34 themselves being of different colors, can be arranged into a predetermined array or grouping, as set forth above, to solve the above set forth problems.

For purposes of simplicity, FIG. 1 has been shown without a full cover portion 80 covering the interior or center section or more specifically the enlarged apertures of the opposite ends 14 and 16. Such a cover structure and its relative disposition to the frame structure 40 is clearly disclosed in FIGS. 1, 3 and 7.

Now that the invention has been described,

What is claimed is:

1. A game assembly in the form of a portably constructed, hand-held and manipulatable puzzle, said assembly comprising;

(a) a track structure having an elongated closed configuration defining a continuous path of travel, (b) a plurality of pieces movably mounted on said track structure and interconnected therewith to travel along said path of travel, (c) said plurality of pieces movable in successive and adjacent relation to one another along a length of said track structure and each being contrastingly designated on opposite exposed surfaces thereof, (d) said track structure comprising a plurality of track segments each of which is movable relative to other track segments and selectively positionable into one of at least two operable positions, (e) each of said pieces movable with a respective one of said plurality of track segments on which it is mounted between said operable positions of said one track segment, (f) connecting means secured to said track structure and interconnected between each of said plurality of track segments thereof for selectively positioning and maintaining each of said plurality of track segments in one of said operative positions relative to the others of said plurality of track segments, and (g) whereby selective positioning of said plurality of pieces into a preferred array determined by the disposition of said contrastingly designated exposed faces thereof is accompanied by portions of said pieces along said path of travel.

2. An assembly as in claim 1 wherein said connecting means comprises a frame structure extending substantially along the length of said track structure between opposite ends thereof and configured for interconnection by said plurality of track segments to one another.

3. An assembly as in claim 2 wherein said frame structure comprises a main support member extending between opposite ends of said track structure and a plurality of brace members each secured to said main support member and extending outwardly therefrom into communication with one of said plurality of track segments.

4. An assembly as in claim 3 wherein said plurality of brace members are movably connected to said main support member and attached to a respective one of said track segments so as to move therewith, said plurality of track segments and said plurality of brace elements movable longitudinally and rotationally relative to said main support member upon positioning of said track segments between said operable positions.

5. An assembly as in claim 4 wherein each of said plurality of pieces are movable with respective ones of said plurality of track segments on which they are mounted upon positioning of said track segments between said operable positions.

6. An assembly as in claim 1 wherein said two operable positions of each track segment are defined by a reversed orientation relative to one another.

7. An assembly as in claim 4 further comprising biasing means mounted on said main support member and disposed in biasing engagement with said plurality of brace elements for normally biasing said track segments into one of said operable positions.

8. An assembly as in claim 7 wherein said main support member comprises an elongated shaft extending substantially between opposite ends of said track structure, said plurality of brace elements extending outwardly from said shaft into fixed engagement with respective ones of said track segments.

9. An assembly as in claim 8 wherein said plurality of brace elements are disposable along the length of said shaft as respective ones of said plurality of track segments are disposed between said operable positions.

10. An assembly as in claim 9 wherein said biasing means comprises a plurality of spring elements mounted on said shaft in biasing engagement with said plurality of brace elements, said brace elements disposable against a biasing force of said plurality of springs as said track segments are disposed between said operable positions.

11. An assembly as in claim 10 wherein each of said springs are disposed to normally bias at least one brace element and a respective track segment attached thereto into one of said operable positions.

12. An assembly as in claims 1 wherein said track structure comprises said plurality of track segments removably disposed in and end-to-end orientation to define each of said operable positions.

13. An assembly as in claim 12 wherein said track structure and each of said plurality of track segments include an elongated channel extending substantially continuously along the length thereof, said plurality of pieces having a transverse dimension along at least a portion thereof being greater than the transverse dimension of said channel, said plurality of pieces slidable along the length of said track structure while being removably retained within said channel.

14. An assembly as in claim 13 wherein said track structure comprises two elongated spaced apart flanges extending along and defining opposite longitudinal boundaries of said channel, each of said plurality of pieces comprising two substantially oppositely disposed grooves each positioned thereon to slidably receive a corresponding one of said flanges.

15. An assembly as in claim 1 wherein said track structure comprises a substantially figure 8 configuration including oppositely disposed end loops interconnected to one another by a center assembly, each of said end loops comprising at least one of said plurality of track segments removably interconnected to one another by said center assembly.

16. An assembly as in claim 15 wherein said center assembly comprises a first track portion removably connected to and correspondingly oriented with a first extremity of each end loop; said center assembly further comprising a second track portion removably connected and correspondingly oriented with a second extremity of each end loop.

17. An assembly as in claim 16 wherein said first and said second track portions are respectively oriented to define a direction of travel along said path of travel in substantially transversely oriented directions relative to one another.

18. An assembly as in claim 1 further comprising a cover means secured to said track structure and extending inwardly therefrom for covering of space within peripheral boundaries of said continuous path of travel.

* * * * *